US011204564B2

(12) United States Patent
Miyazaki

(10) Patent No.: US 11,204,564 B2
(45) Date of Patent: Dec. 21, 2021

(54) IMAGE FORMING APPARATUS AND CONTROL METHOD

(71) Applicant: TOSHIBA TEC KABUSHIKI KAISHA, Tokyo (JP)

(72) Inventor: Yasunari Miyazaki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/185,875

(22) Filed: Feb. 25, 2021

(65) Prior Publication Data

US 2021/0286286 A1 Sep. 16, 2021

Related U.S. Application Data

(63) Continuation of application No. 16/817,499, filed on Mar. 12, 2020, now Pat. No. 10,962,898.

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/55; G03G 15/553
See application file for complete search history.

(56) References Cited

U.S. PATENT DOCUMENTS 6,072,517 A * 6/2000 Fork ..... B41J 2/45 347/130
6,188,420 B1 2/2001 Kuribayashi et al.
7,042,483 B2 5/2006 Wong et al.
7,199,769 B2 * 4/2007 Hyuga ..... G06K 15/129 345/77
7,885,006 B2 2/2011 Yamamura
8,835,197 B2 * 9/2014 Wu ..... H01L 51/56 438/24
2007/0120939 A1 * 5/2007 Arai ..... B41J 2/45 347/132
2015/0311731 A1 10/2015 Tatsumoto et al.

FOREIGN PATENT DOCUMENTS

JP H11-274569 A 10/1999
JP 2002-361924 A 12/2002
JP 2017-087454 A 5/2017

OTHER PUBLICATIONS

Non-Final Office Action on U.S. Appl. No. 16/817,499 dated Sep. 3, 2020.
Notice of Allowance on U.S. Appl. No. 16/817,499 dated Dec. 15, 2020.

* cited by examiner

*Primary Examiner* — Francis C Gray
(74) *Attorney, Agent, or Firm* — Foley & Lardner LLP

(57) ABSTRACT

An image forming apparatus includes a photoreceptor, a charger, an exposure unit, and a control unit. The charger charges a surface of the photoreceptor. The exposure unit exposes the photoreceptor charged by the charger using a light-emitting diode. The amount of light of a light-emitting diode gradually decreases over time. The control unit controls the exposure unit so that exposure energy by the exposure unit is constant.

6 Claims, 7 Drawing Sheets

IMAGE FORMING APPARATUS AND CONTROL METHOD

CROSS-REFERENCE TO RELATED APPLICATION

This application is a continuation of U.S. application Ser. No. 16/817,499 filed Mar. 12, 2020, the entire contents of which are incorporated herein by reference.

FIELD

Embodiments described herein relate generally to an image forming apparatus and a control method.

BACKGROUND

There are image forming apparatuses that expose photoreceptors using light-emitting diodes. The amount of light of a light-emitting diode gradually decreases over time. When the amount of light decreases, exposure energy decreases.

DETAILED DESCRIPTION

In general, according to one embodiment, an image forming apparatus includes a photoreceptor, a charger, an exposure unit, and a control unit (controller). The charger charges a surface of the photoreceptor. The exposure unit exposes the photoreceptor charged by the charger using a light-emitting diode. The control unit controls the exposure unit so that exposure energy by the exposure unit is constant.

Hereinafter, an image forming apparatus according to an exemplary embodiment will be described with reference to the drawings.

Figure 1:
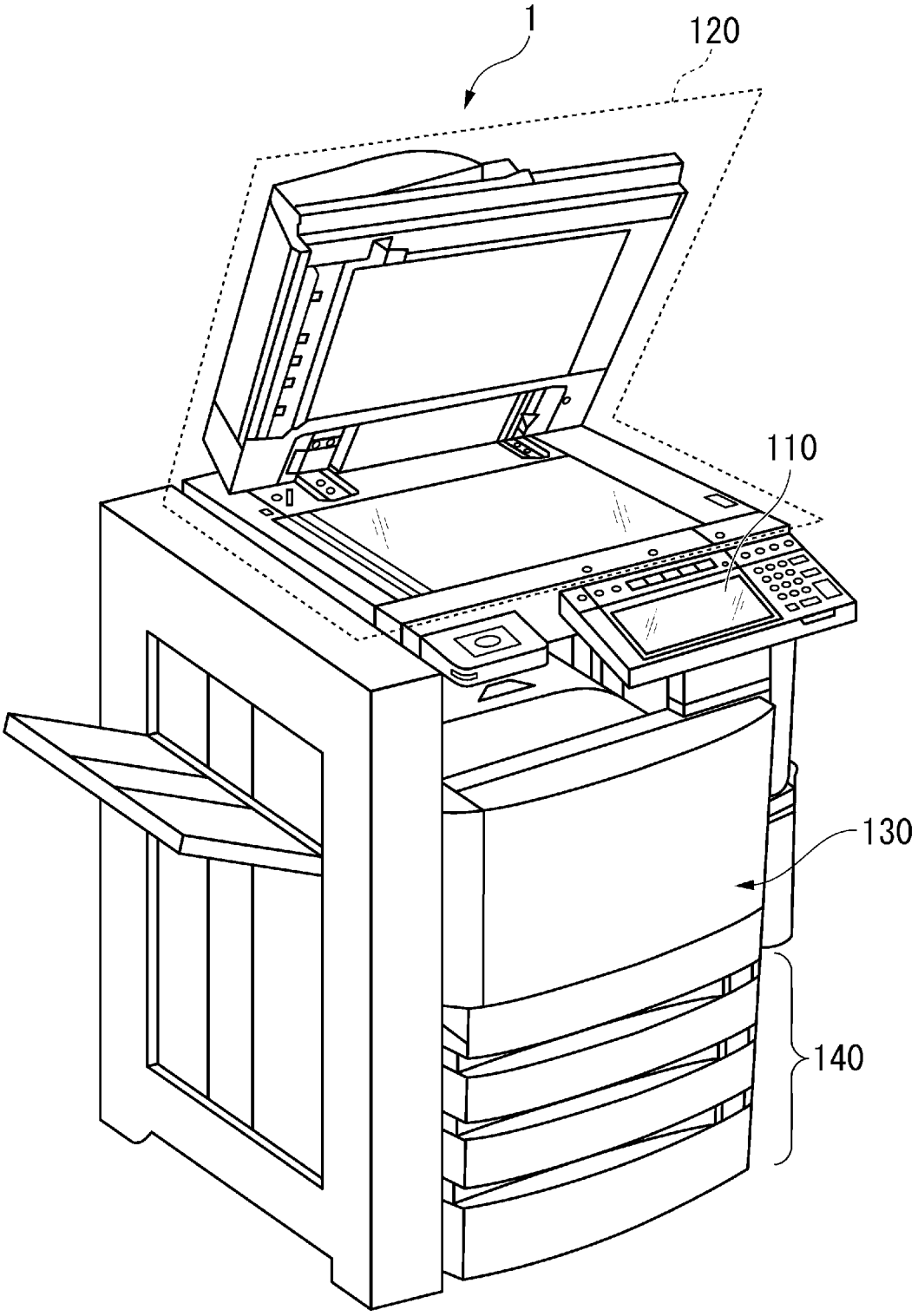
FIG. 1 is an external view illustrating an example of an image forming apparatus according to an embodiment.

FIG. 1 is an external view illustrating an example of an image forming apparatus 1 according to an embodiment. For example, the image forming apparatus 1 is a multi-function peripheral (MFP). The image forming apparatus 1 reads an image formed on a sheet-shaped medium such as paper and generates digital data (an image file). The image forming apparatus 1 forms an image on paper using toner based on the digital data.

The image forming apparatus 1 includes a display unit 110, an image reading unit 120, an image forming unit 130, and a feed unit 140.

The display unit 110 operates an output interface that displays text and an image. The display unit 110 also operates an input interface that receives an instruction from a user. For example, the display unit 110 is a liquid crystal display that has a touch panel.

The image reading unit 120 is a color scanner. The image reading unit 120 reads an image formed on a sheet-shaped medium such as paper. The image reading unit 120 converts the read image on the medium into digital data. For example, the image reading unit 120 includes a contact image sensor (CIS) or a charge coupled device (CCD).

The image forming unit 130 forms an image on a medium using toner. The image forming unit 130 forms an image on a medium based on image data read by the image reading unit 120 or image data received from an external device.

The feed unit 140 accommodates a printing medium. The feed unit 140 supplies the printing medium to the image forming unit 130.

In the image forming unit 130 according to the embodiment, at least colored toner is used. The colored toner is each toner that contains pigment of yellow (Y), magenta (M), cyan (C), and black (K).

Figure 2:
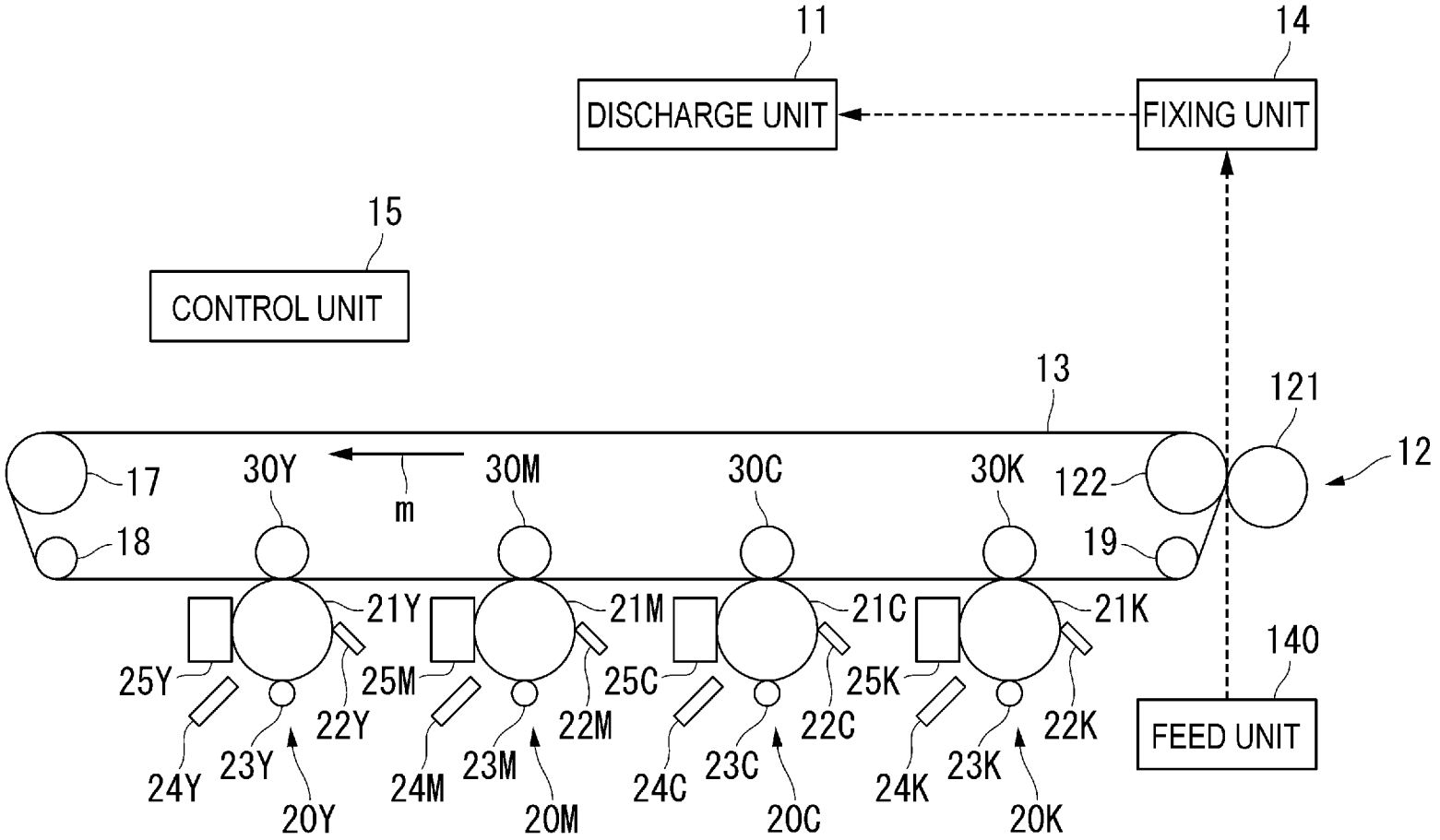
FIG. 2 is a schematic diagram illustrating an example configuration of the image forming apparatus according to the embodiment.

FIG. 2 is a schematic diagram illustrating an example configuration of the image forming apparatus 1 according to the embodiment.

The image forming apparatus 1 is an intermediate transfer-type image forming apparatus. The image forming apparatus 1 includes a discharge unit 11, a primary transfer unit 30, a secondary transfer unit 12 (a counter roller 122 and a secondary transfer roller 121), an intermediate transfer belt 13, a fixing unit 14, a control unit 15, and a feed unit 140.

The control unit 15 controls the entire image forming apparatus. The control unit 15 includes an arithmetic operation device such as a processor and a storage device such as a memory. The discharge unit 11 discharges paper 40 subjected to fixing by the fixing unit 14 to a discharge space (not illustrated).

The primary transfer unit 30 includes an image forming station 20Y, an image forming station 20M, an image forming station 20C, an image forming station 20K, a primary transfer roller 30Y, a primary transfer roller 30M, a primary transfer roller 30C, and a primary transfer roller 30K.

The image forming station 20Y is disposed upstream in a conveyance path of the intermediate transfer belt 13 from the image forming station 20M. The image forming station 20Y includes a photoreceptor 21Y, a photoreceptor cleaner 22Y, a charge device 23Y, an exposure device 24Y, and a development device 25Y.

The image forming station 20M is disposed upstream in the conveyance path of the intermediate transfer belt 13 from the image forming station 20C. The image forming station 20M includes a photoreceptor 21M, a photoreceptor cleaner 22M, a charge device 23M, an exposure device 24M, and a development device 25M.

The image forming station 20C is disposed upstream in the conveyance path of the intermediate transfer belt 13 from the image forming station 20K. The image forming station 20C includes a photoreceptor 21C, a photoreceptor cleaner 22C, a charge device 23C, an exposure device 24C, and a development device 25C.

The image forming station 20K is disposed downstream in the conveyance path of the intermediate transfer belt 13 from the image forming station 20C. The image forming station 20K includes a photoreceptor 21K, a photoreceptor cleaner 22K, a charge device 23K, an exposure device 24K, and a development device 25K.

Each photoreceptor 21Y, 21M, 21C, and 21K includes a surface containing organic photoconductors (OPC).

The photoreceptor cleaners 22Y, 22M, 22C, and 22K remove remaining toner from the surfaces of the photoreceptors 21Y, 21M, 21C, and 21K. The remaining toner is toner that remains on the surface of the photoreceptor after primary transfer.

The charge devices 23Y, 23M, 23C, and 23K uniformly charge the surfaces of the photoreceptors 21Y, 21M, 21C, and 21K, respectively. For example, the charge devices 23Y, 23M, 23C, and 23K are scorotron-type corona chargers.

The exposure devices 24Y, 24M, 24C, and 24K acquire image data from the control unit 15. The exposure devices 24Y, 24M, 24C, and 24K radiate laser light to the photoreceptors 21Y, 21M, 21C, and 21K in accordance with the acquired image data. The exposure devices 24Y, 24M, 24C, and 24K perform scanning with the laser light in axis directions of the photoreceptors 21Y, 21M, 21C, and 21K. Through scanning exposure of the laser light, electrostatic latent images are formed on the photoreceptors 21Y, 21M, 21C, and 21K.

Each of the development devices 25Y, 25M, 25C, and 25K includes a development roller and a development motor.

The development device 25Y contains a developer Y. The development device 25M contains a developer M. The development device 25C contains a developer C. The development device 25K contains a developer K. Each developer Y, M, C and K is a mixture of toner and magnetic carrier.

The development device 25Y applies a development bias to the development roller. The development bias enables the developer Y to be supplied to the photoreceptor 21Y. Then, the electrostatic latent image formed on the photoreceptor 21Y by the exposure device 24Y is formed as a toner image 42 of yellow toner.

The development device 25M applies a development bias to the development roller. The development bias enables the developer M to be supplied to the photoreceptor 21M. Then, the electrostatic latent image formed on the photoreceptor 21M by the exposure device 24M is formed as a toner image 43 of magenta toner.

The development device 25C applies a development bias to the development roller. The development bias enables the developer C to be supplied to the photoreceptor 21C. Then, the electrostatic latent image formed on the photoreceptor 21C by the exposure device 24C is formed as a toner image 44 of cyan toner.

The development device 25K applies a development bias to the development roller. The development bias enables the developer K to be supplied to the photoreceptor 21K. Then, the electrostatic latent image formed on the photoreceptor 21K by the exposure device 24K is formed as a toner image 45 of black toner.

The intermediate transfer belt 13 abuts on the primary transfer unit 30. The intermediate transfer belt 13 is supported by a backup roller 17, a driven roller 18, and a tension roller 19. The intermediate transfer belt 13 is conveyed in a direction indicated by an arrow m.

The primary transfer roller 30Y presses against the photoreceptor 21Y with the intermediate transfer belt 13 interposed therebetween. A transfer bias is applied to the primary transfer roller 30Y. Thus, the toner image 42 is transferred (primarily transferred) to the intermediate transfer belt 13.

The primary transfer roller 30M presses against the photoreceptor 21M with the intermediate transfer belt 13 interposed therebetween. A transfer bias is applied to the primary transfer roller 30M. Thus, the toner image 43 is transferred (primarily transferred) to the intermediate transfer belt 13.

The primary transfer roller 30C presses against the photoreceptor 21C with the intermediate transfer belt 13 interposed therebetween. A transfer bias is applied to the primary transfer roller 30C. Thus, the toner image 44 is transferred (primarily transferred) to the intermediate transfer belt 13.

The primary transfer roller 30K presses against the photoreceptor 21K with the intermediate transfer belt 13 interposed therebetween. A transfer bias is applied to the primary transfer roller 30K. Thus, the toner image 45 is transferred (primarily transferred) to the intermediate transfer belt 13. Here, the transfer bias is applied in the order of the primary transfer roller 30Y, the primary transfer roller 30M, the primary transfer roller 30C, and then the primary transfer roller 30K.

Paper is supplied from the feed unit 140 to the secondary transfer unit 12. The secondary transfer unit 12 includes the secondary transfer roller 121 and the counter roller 122.

The secondary transfer unit 12 is disposed downstream from the image forming station 20K. The secondary transfer roller 121 is disposed to face the counter roller 122 via the intermediate transfer belt 13. The secondary transfer roller 121 is a conductive roller, for example. A predetermined secondary transfer bias is applied to the secondary transfer roller 121. Thus, the secondary transfer roller 121 transfers (secondarily transfers) the toner images 42 to 45 on the intermediate transfer belt 13 to the paper from the feed unit 140. The toner images stacked in the order of the toner image 42, the toner image 43, the toner image 44, and the toner image 45 on the intermediate transfer belt 13 are secondarily transferred to the paper 40. Accordingly, images stacked in the order of the toner image 45, the toner image 44, the toner image 43, and the toner image 42 are formed on the paper 40. After the secondary transfer ends, the intermediate transfer belt 13 is cleaned by a belt cleaner (not illustrated).

The fixing unit 14 heats, pressurizes, and fixes the toner images to the paper. For example, the fixing unit 14 is a fixing device using electromagnetic induction heating.

Next, a control method of controlling the exposure devices 24Y, 24M, 24C, and 24K so that exposure energy by the exposure devices 24Y, 24M, 24C, and 24K is constant will be described. Hereinafter, when the exposure devices 24Y, 24M, 24C, and 24K are not particularly distinguished from each other, any one is expressed as an exposure device 24. When the photoreceptors 21Y, 21M, 21C, and 21K are not particularly distinguished from each other, any one is expressed as a photoreceptor 21. When the charge devices 23Y, 23M, 23C, and 23K are not particularly distinguished from each other, any one is expressed as a charge device 23.

Figure 3:
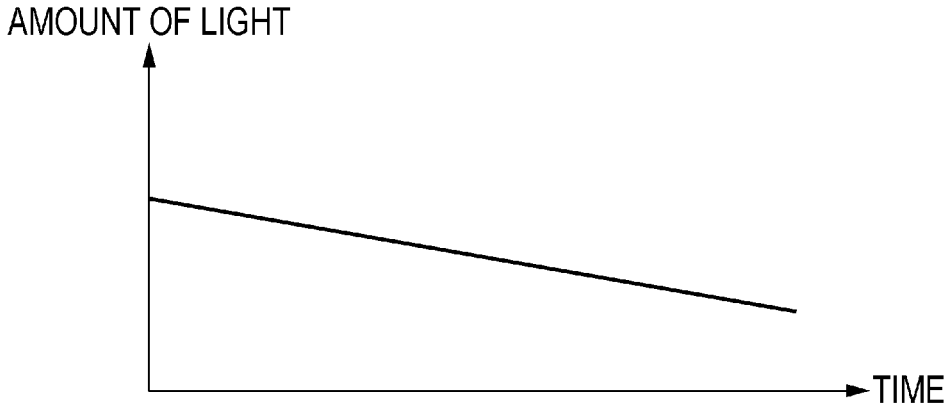
FIG. 3 is a diagram illustrating the degree of decrease in a light emission amount from an organic light-emitting diode over time.

The exposure device 24 according to the embodiment exposures the photoreceptor 21 charged by the charge device 23 using an organic light emitting diode (OLED). In the organic light emitting diode, the degree of decrease in the light emission amount over time is greater than that in a general light-emitting diode. FIG. 3 is a diagram illustrating the degree of decrease in a light emission amount from an organic light-emitting diode. In a graph illustrated in FIG. 3, the horizontal axis represents a light emission time and the vertical axis represents a light emission amount. As illustrated in FIG. 3, the light emission amount from the organic light emitting diode decreases over time.

When the light emission amount from the organic light emitting diode decreases, exposure energy to the photoreceptor 21 decreases. The exposure energy is determined in accordance with the light emission amount and a light emission duty ratio (hereinafter simply referred to as "duty ratio"). To obtain the same exposure energy, it is considered that the light emission amount is increased to decrease the duty ratio or the light emission amount is decreased to increase the duty ratio.

When the light emission amount is increased to decrease the duty ratio, the organic light emitting diode deteriorates more easily than when the light emission amount is decreased to increase the duty ratio. Accordingly, in the embodiment, by performing control such that the light emission amount is decreased to increase the duty ratio, the exposure energy is constantly maintained and the deterioration in the organic light emitting diode is suppressed.

Figure 4:
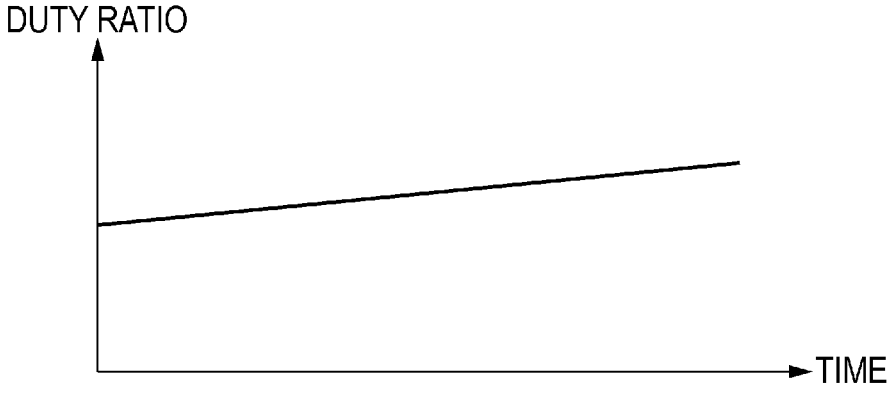
FIG. 4 is a diagram illustrating the degree of increase in a duty ratio of an organic light-emitting diode over time.

FIG. 4 is a diagram illustrating the degree of increase in a duty ratio. In a graph illustrated in FIG. 4, the horizontal axis represents a light emission time and the vertical axis represents a duty ratio. As illustrated in FIG. 4, the control unit 15 increases the duty ratio over time.

Figure 5:
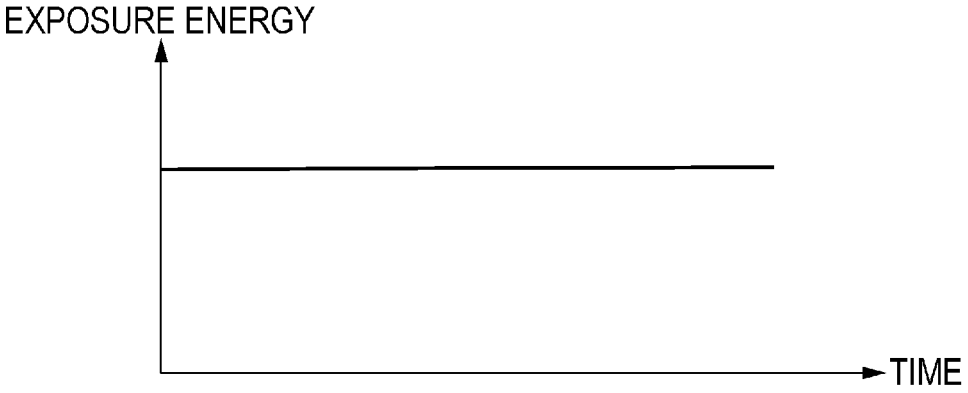
FIG. 5 is a diagram illustrating exposure energy of an organic light-emitting diode over time.

FIG. 5 is a diagram illustrating exposure energy. In a graph illustrated in FIG. 5, the horizontal axis represents a light emission time and the vertical axis represents exposure energy. The control unit 15 controls the exposure device 24 so that the exposure energy is constant, as illustrated in FIG. 5, by increasing the duty ratio.

Figure 6:
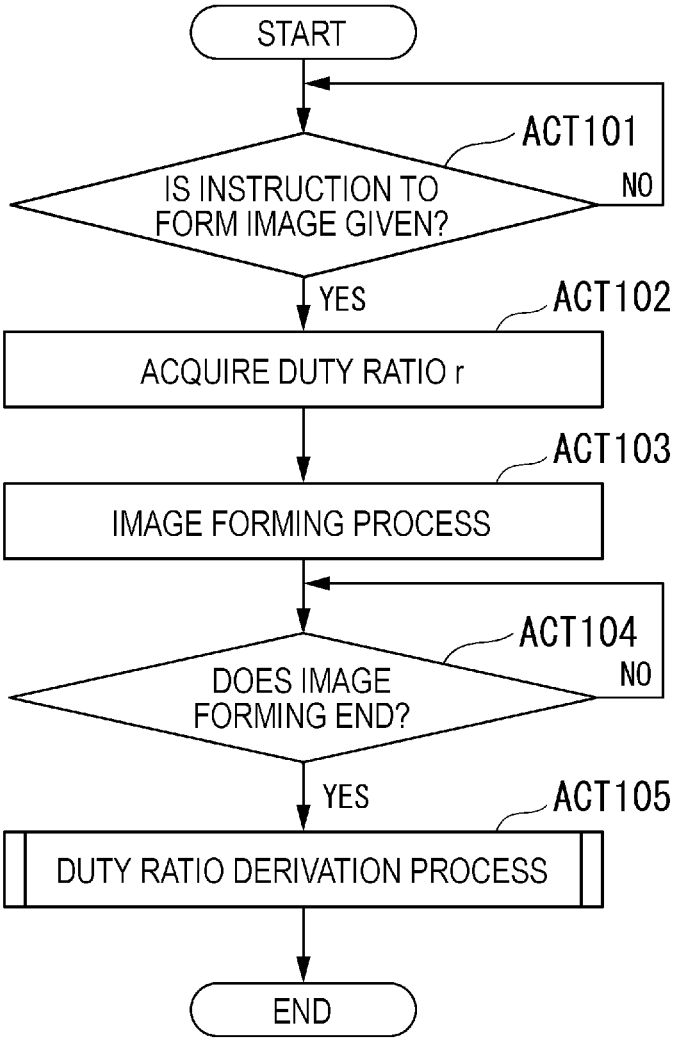
FIG. 6 is a flowchart illustrating a common process flow in three different control methods according to the embodiment.

A specific control method will be described with reference to a flowchart. In the embodiment, there are three control methods. FIG. 6 is a flowchart illustrating a process flow common in all three control methods.

The control unit 15 determines whether an instruction to form an image is given (ACT101). Here, examples of the instruction to form the image include an instruction to form an image from a user via the display unit 110 or an instruction to form an image from another device via a network.

When the instruction to form the image is given (YES in ACT101), the control unit 15 acquires a duty ratio r stored in a storage device, such as a memory or the like. The duty ratio r is stored in a nonvolatile storage device. The control unit 15 performs an image forming process (ACT103). In the image forming process herein, the control unit 15 controls the exposure device 24 such that exposure is performed at the duty ratio r acquired in ACT102.

The control unit 15 determines whether the image forming process ends (ACT104). When the image forming process ends (YES in ACT104), the control unit 15 performs a duty ratio derivation process of deriving a duty ratio (ACT105) and ends the present process. In the duty ratio derivation process, as described above, there are three different processes. The three processes include a process A, a process B, and a process C. The derived duty ratio is stored as the duty ratio r acquired in ACT102. That is, the duty ratio derivation process is a process of updating the duty ratio r.

Figure 7:
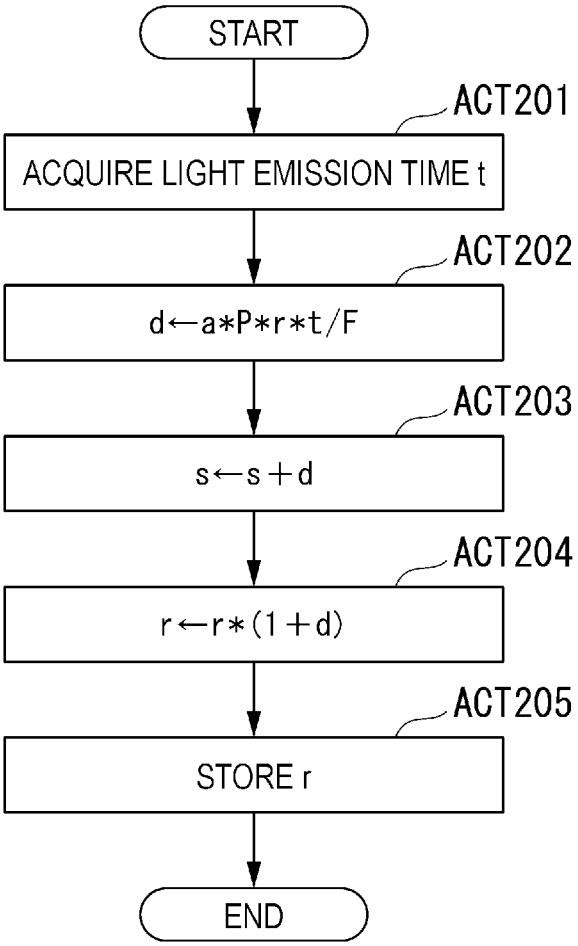
FIG. 7 is a flowchart illustrating a flow of a process A according to the embodiment.

FIG. 7 is a flowchart illustrating a flow of the process A. The process A is a process of deriving a duty ratio based on an amount of light from the organic light emitting diode, a duty ratio of the organic light emitting diode, and a light emission time of the organic light emitting diode.

The control unit 15 acquires a light emission time t (ACT201). The light emission time herein is a light emission time of the organic light emitting diode in the image forming process of ACT103. The control unit 15 performs the following substitution for d (ACT202):

$$d=(a*P*r*t)/F$$

Here, "*" is a multiplication operator.

In the equation above, a is a coefficient. P is an amount of light, r is the duty ratio acquired in ACT102, and t is the light emission time acquired in ACT201. F is a lifespan determination value. F and a are constants determined in advance in accordance with performance or the like of the organic light emitting diode. P, r, and t in (a*P*r*t)/F are values in the image forming process of ACT103. Accordingly, d is a value determined for each image forming process of ACT103. In addition, d is a value indicating the degree of use of the organic light emitting diode in the present image forming process.

The control unit 15 substitutes a sum of current s and d as a new s (ACT203). Here, s is accumulation of d obtained in ACT202 for each image forming process. In addition, s is stored in the nonvolatile storage device.

The control unit 15 substitutes a product of the current duty ratio r and (1+d) as a new duty ratio r (ACT204). The control unit 15 stores the new duty ratio r in the nonvolatile storage device (ACT205) and ends the process. The new duty ratio r stored in this way is acquired in ACT102 and is used in a subsequent image forming process.

As described above, d is a value determined for each image forming process. Therefore, the s is a value indicating the accumulation of the degree of use of the organic light emitting diode until now. In addition, since d is positive, s monotonically increases. When the lifespan of the organic light emitting diode is expired, a and Fare determined so that s reaches F.

Figure 8:
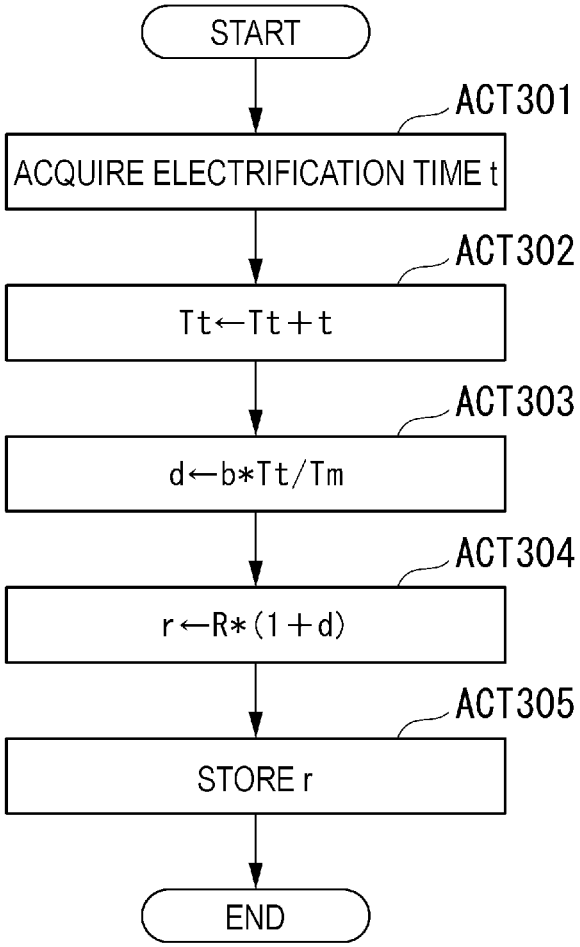
FIG. 8 is a flowchart illustrating a flow of a process B according to the embodiment.

FIG. 8 is a flowchart illustrating a flow of the process B. The process B is a process of deriving a duty ratio based on an integrated value of an electrification time of the organic light emitting diode and an electrification limit time of the organic light emitting diode.

The control unit 15 acquires an electrification time t (ACT301). The electrification time herein is an electrification time of the organic light emitting diode in the image forming process of ACT103. The control unit 15 substitutes a sum of current $T_t$ and t as new $T_t$ (ACT302). $T_t$ is an integrated value of the electrification time. $T_t$ is stored in the nonvolatile storage device.

The control unit 15 performs the following substitution (ACT303):

$$d=(b*T_t)/T_m$$

Here, "*" is a multiplication operator. b is a coefficient. $T_m$ is an electrification limit time. $T_m$ and b are constants determined in advance based on performance or the like of the organic light emitting diode. When the lifespan of the organic light emitting diode is expired, b and $T_m$ are determined so that $T_t$ reaches $T_m$.

The control unit 15 substitutes a product of an initial value R of the duty ratio and (1+d) as a new duty ratio r (ACT304). The initial value R of the duty ratio is stored in the nonvolatile storage device. The control unit 15 stores the new duty ratio r in the nonvolatile storage device (ACT305) and ends the process. The new duty ratio r stored in this way is acquired in ACT102 and is used in a subsequent image forming process.

In this way, in the process B, the duty ratio is derived based on the integrated value of the electrification time of the organic light emitting diode and the electrification limit time of the organic light emitting diode. Thus, the control unit 15 can constantly maintain exposure energy and suppress deterioration in the organic light emitting diode.

Figure 9:
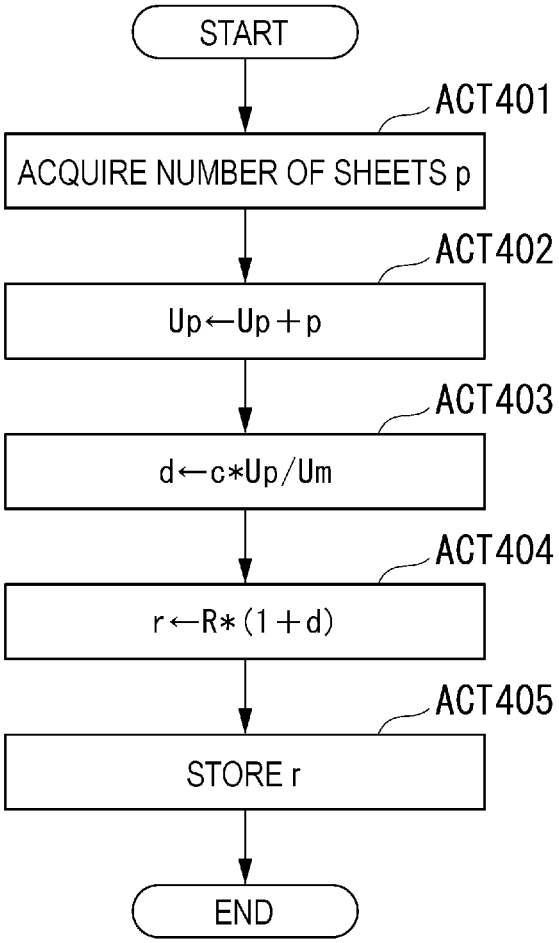
FIG. 9 is a flowchart illustrating a flow of a process C according to the embodiment.

FIG. 9 is a flowchart illustrating a flow of the process C. The process C is a process of deriving a duty ratio based on the number of sheets on which images are formed by the image forming apparatus 1.

The control unit 15 acquires the number of sheets p (ACT401). The number of sheets herein is the number of sheets on which images are formed in the image forming process of ACT103. The control unit 15 substitutes a sum of current $U_p$ and p as new $U_p$ (ACT402). $U_p$ is the number of fed sheets. $U_p$ is stored in the nonvolatile storage device.

The control unit 15 performs the following substitution (ACT403):

$$d=(c*U_p)/U_m$$

Here, "*" is a multiplication operator. c is a coefficient. $U_m$ is a feeding lift counter. $U_m$ and c are constants determined in advance based on performance or the like of the organic light emitting diode. When the lifespan of the organic light emitting diode is expired, c and $U_m$ are determined so that $U_p$ reaches $U_m$.

The control unit 15 substitutes a product of an initial value R of the duty ratio and (1+d) as a new duty ratio r (ACT404). The initial value R of the duty ratio is stored in the nonvolatile storage device. The control unit 15 stores the new duty ratio r in the nonvolatile storage device (ACT405) and ends the process. The new duty ratio r stored in this way is acquired in ACT102 and is used in a subsequent image forming process.

In this way, in the process C, the duty ratio is derived based on the number of sheets on which images are formed in the image forming apparatus 1. Thus, the control unit 15 can constantly maintain exposure energy and suppress deterioration in the organic light emitting diode.

The duty ratio is derived based on the degree of actual use of the organic light emitting diode (the light emission time, the electrification time, and the number of fed sheets) in all of the above-described processes A, B, and C. Accordingly, the control unit 15 can perform control based on an actual situation.

In the embodiment, the control is performed in accordance with the duty ratio rather than the light emission amount. Thus, in the embodiment, the lifespan of the organic light emitting diode can be extended more than when the light emission amount is increased.

In the embodiment, the organic light emitting diode is described as an example, but an exemplary embodiment is not limited thereto. Any light emitting device may be used as long as the light emitting device can control exposure energy at a duty ratio.

The expressions used to obtain d described in FIGS. 7, 8, and 9 are not limited. An expression used to obtain d may be appropriately determined in accordance with characteristics of the organic light emitting diode so that the exposure energy is constant.

A program (a control program) for realizing some or all of the functions of the above-described control unit 15 is recorded on a computer-readable recording medium. The functions may be realized by executing the program recorded on the recording medium by a CPU.

The "computer-readable recording medium" refers to a portable medium and a storage unit. The portable medium is, for example, a flexible disc, a magneto-optical disc, a ROM, or a CD-ROM. The storage unit is, for example, a hard disk built in the computer system. Further, the "computer-readable recording medium" is a network, a medium which dynamically retains a program in a short time, or a medium which retains a program for a given time. The network is, for example, the Internet. The medium which dynamically retains a program is, for example, a communication line when a program is transmitted via a communication channel. For example, the medium which retains a program for a given time is a volatile memory inside a computer system serving as a server or a client. The program may be a program for realizing some of the above-described functions. The program may be a program that realizes the above-described functions in combination with a program already recorded on the computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:
- a photoreceptor;
- a charger configured to charge a surface of the photoreceptor;
- an exposure unit comprising a light-emitting diode configured to irradiate the surface of the photoreceptor; and
- a controller configured to:
  - control the exposure unit to produce constant exposure energy over time,
  - adjust a light emission duty ratio of the light-emitting diode of the exposure unit based on an amount of light radiated by the light-emitting diode, a current value of the light emission duty ratio of the light-emitting diode, and a light emission time of the light-emitting diode, and
  - adjust the light emission duty ratio based on a lifespan determination value determined according to performance of the light-emitting diode.

2. The apparatus according to claim 1, wherein the light-emitting diode is one of an organic light-emitting diode or an organic laser diode.

3. An image forming apparatus comprising:
- a photoreceptor;
- a charger configured to charge a surface of the photoreceptor;
- an exposure unit comprising a light-emitting diode configured to irradiate the surface of the photoreceptor; and
- a controller configured to:
  - control the exposure unit to produce constant exposure energy over time, and
  - adjust a light emission duty ratio of the light-emitting diode based on a lifespan determination value determined according to performance of the light-emitting diode.

4. The apparatus according to claim 3, wherein the light-emitting diode is one of an organic light-emitting diode or an organic laser diode.

5. An image forming apparatus comprising:
- a photoreceptor;
- a charger configured to charge a surface of the photoreceptor;
- an exposure unit comprising a light-emitting diode configured to irradiate the surface of the photoreceptor; and
- a controller configured to:

control the exposure unit to produce constant exposure energy over time, and adjust a light emission duty ratio of the light-emitting diode of the exposure unit based on an integrated value of an electrification time of the light-emitting diode and an electrification limit time of the light-emitting diode.

6. The apparatus according to claim 5, wherein the light-emitting diode is one of an organic light-emitting diode or an organic laser diode.

* * * * *